United States Patent [19]

Miller et al.

[11] Patent Number: 4,782,765

[45] Date of Patent: Nov. 8, 1988

[54] PELLET FUEL BURNER

[75] Inventors: Bill R. Miller; Ronald G. Coffland, both of Lewiston, Id.

[73] Assignee: MCC Research & Development Corporation, Lewiston, Id.

[21] Appl. No.: 113,754

[22] Filed: Oct. 26, 1987

[51] Int. Cl.[4] ..... F23H 5/18

[52] U.S. Cl. ..... 110/186; 110/110; 110/302

[58] Field of Search ..... 110/110, 205, 302, 287, 110/288, 297, 186

[56] References Cited

U.S. PATENT DOCUMENTS

| | | | |
|---|---|---|---|
| 265,348 | 10/1882 | Tourangin . | |
| 1,565,359 | 12/1925 | Grant | 110/302 |
| 1,607,312 | 11/1926 | Sclierenbeck | 110/302 |
| 1,922,960 | 8/1933 | Klein . | |
| 1,981,947 | 11/1934 | Corbett . | |
| 2,303,406 | 12/1942 | Smerling . | |
| 2,385,811 | 10/1945 | Hotchkiss . | |
| 2,932,712 | 4/1960 | Levin . | |
| 4,308,806 | 1/1982 | Uemura et al. . | |
| 4,335,660 | 6/1982 | Maloney et al. | 110/205 X |
| 4,520,740 | 6/1985 | Carpenter | 110/110 X |
| 4,619,209 | 10/1986 | Traeger et al. . | |

OTHER PUBLICATIONS

"The Modern Way to Burn Wood", Winston Stove, Inc., 1-87.
"At Last", Welenco Manufacturing, Inc., 1-87.
"Computer—Operated Thermostatically—Controlled", Buck Stove Company, 1-87.
"The Hottest New Development in Home—Heating Technology", Pyro Industries, 1-87.
"Collins Hopper 4000", Collins Enterprises, Inc., 1-87.
"Freeland Flame", Deeze, Inc., 1-87.
"Crossfire", Gatlin Energy, Inc., 1-87.
"Welenco Announces . . . ", Welenco Manufacturing, Inc., 1-87.

*Primary Examiner*—Edward G. Favors
*Attorney, Agent, or Firm*—Wells, St. John & Roberts

[57] ABSTRACT

A burner for burning, granular, pellet or similarly sized solid heating fuel includes a retort in which solid fuel is ignited and burned. A peripheral electrical igniter is included within the retort for initiating self-sustaining combustion of the solid fuel at its uppermost surface. Combustion air is supplied centrally within the retort and is emitted radially outward for burning solid fuel evenly across its uppermost surface. Thermostatic control and safety circuits are included for safely and efficiently operating the burner.

27 Claims, 6 Drawing Sheets

PELLET FUEL BURNER

TECHNICAL FIELD

This invention relates generally to burners for burning granular, pellet or similarly sized solid biomass heating fuel.

BACKGROUND OF THE INVENTION

Pellet burners or stoves are becoming increasingly popular. Such burners typically use a biomass fuel in the form of a small pellet ¼–⅜ inch in diameter and one inch in length which is made from waste of the timber industry. Such pellets typically have a heat value of approximately 8500 BTU's per pound.

Pellet burners have advantages over conventional wood burning stoves. One advantage is that substantially less emissions are produced by pellet burners than wood burners. Additionally, almost all pellet burning stoves meet environmental emissions standards and can be vented using conventional dryer-type exhaust hoses. Pellet burning stoves also typically achieve a much higher efficiency than conventional wood stoves due to a more precisely controlled air-fuel mixture ratio in the combustion chamber. Pelletized fuel is also cleaner and easily handled and does not generate the mess created by the handling of wood.

Pellet burner manufacturers continue to strive to increase the efficiency and ease of operation of pellet burning stoves. This invention relates to such improvements.

Although the invention arose primarily out of the needs and concerns in the biomass pellet fuel stove art, it will be apparent to those skilled in the heating art that the teachings of the invention may have applicability to the burning of other granular, pellet or similarly sized solid heating fuels.

BRIEF DESCRIPTION OF THE DRAWINGS

The preferred embodiment of the invention is illustrated in the accompanying drawings, in which:

FIG. 6 is a rear-perspective view of a burn chamber employed within the burner of FIG. 3.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Figure 1:
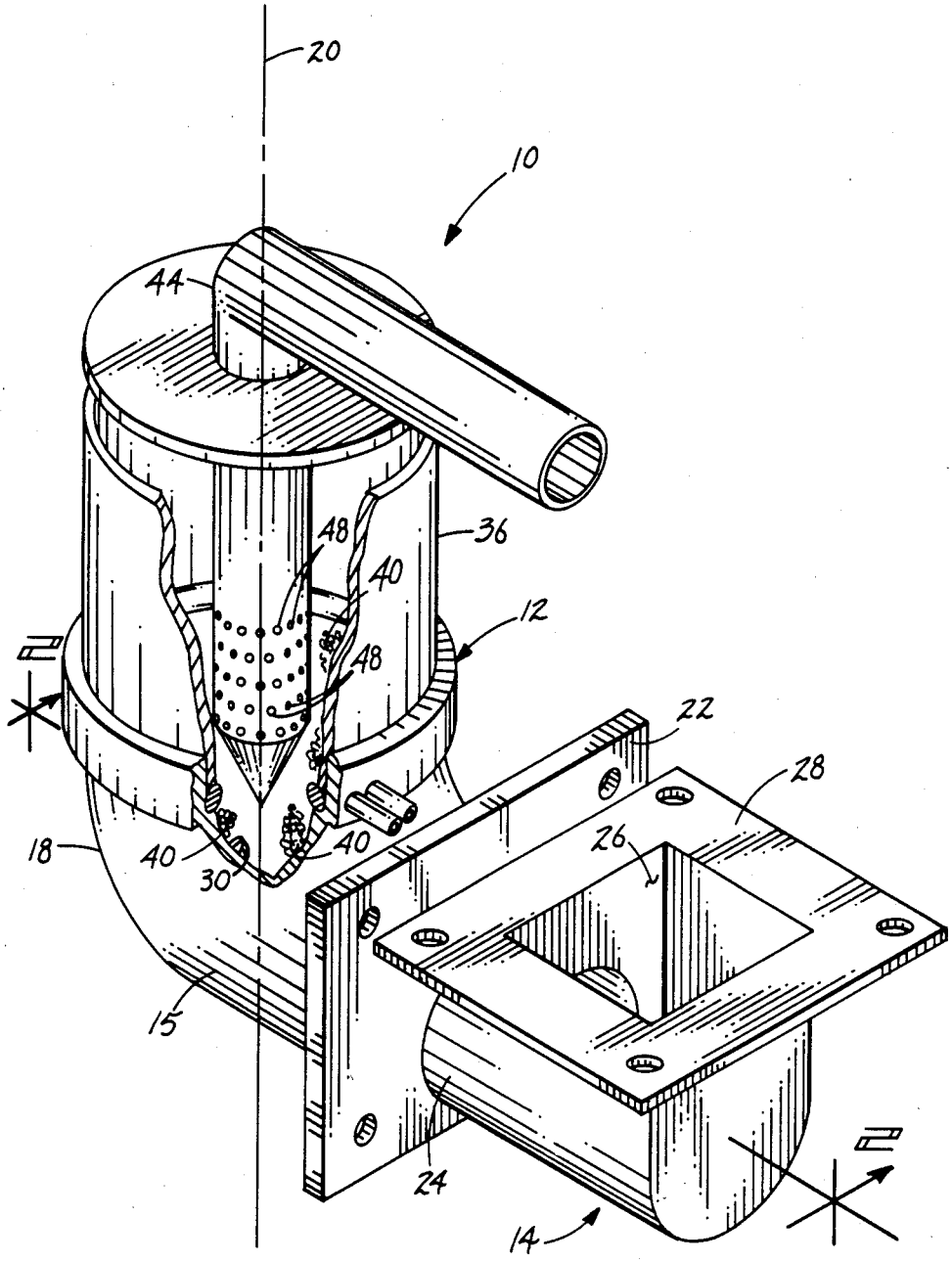
FIG. 1 is a fragmentary perspective view of a burner specifically adapted for burning granular, pellet or similarly sized solid heating fuel in accordance with the invention.
Figure 2:
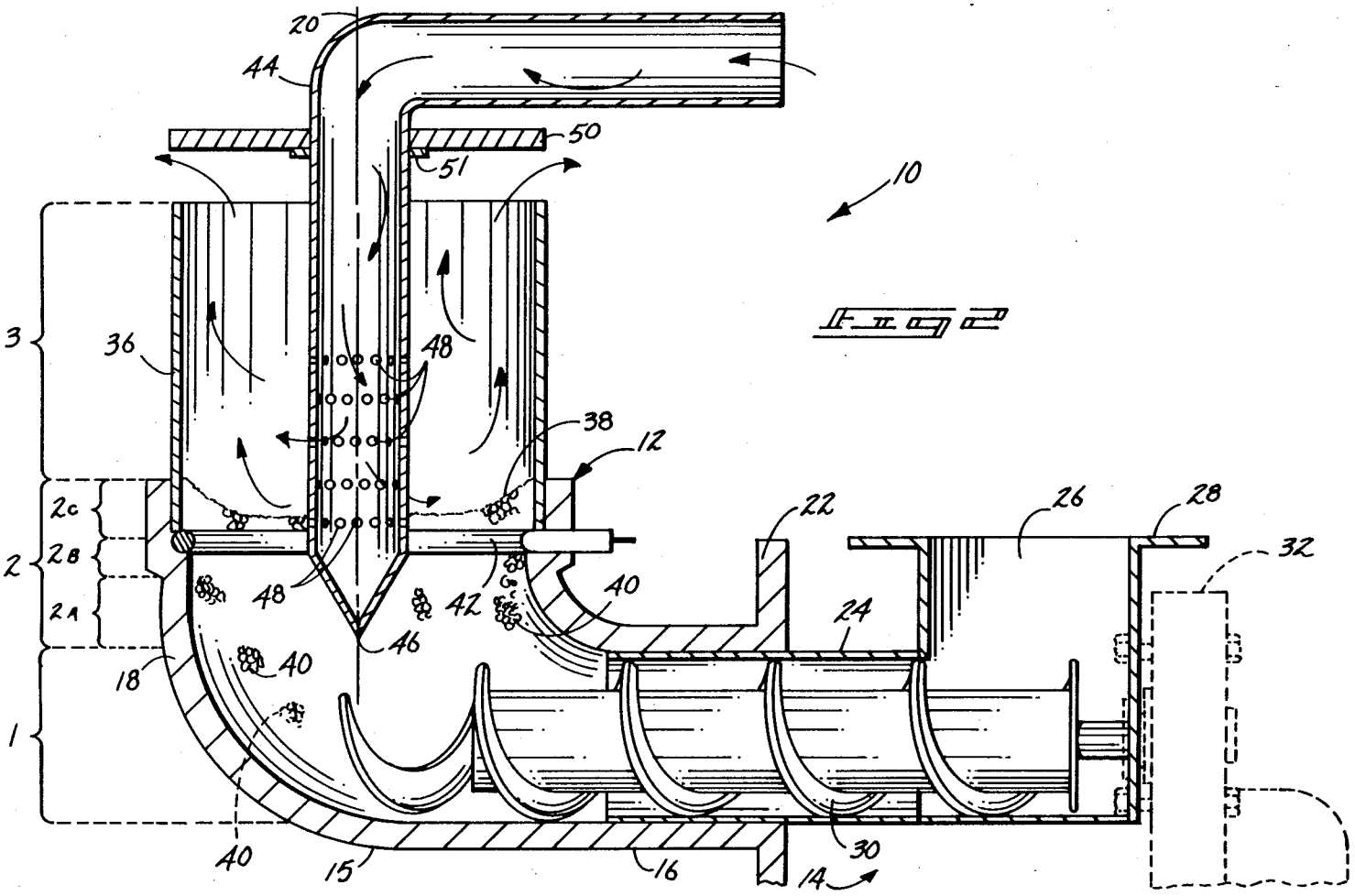
FIG. 2 is a cross-sectional view taken along line 2—2 in FIG. 1.
Figure 3:
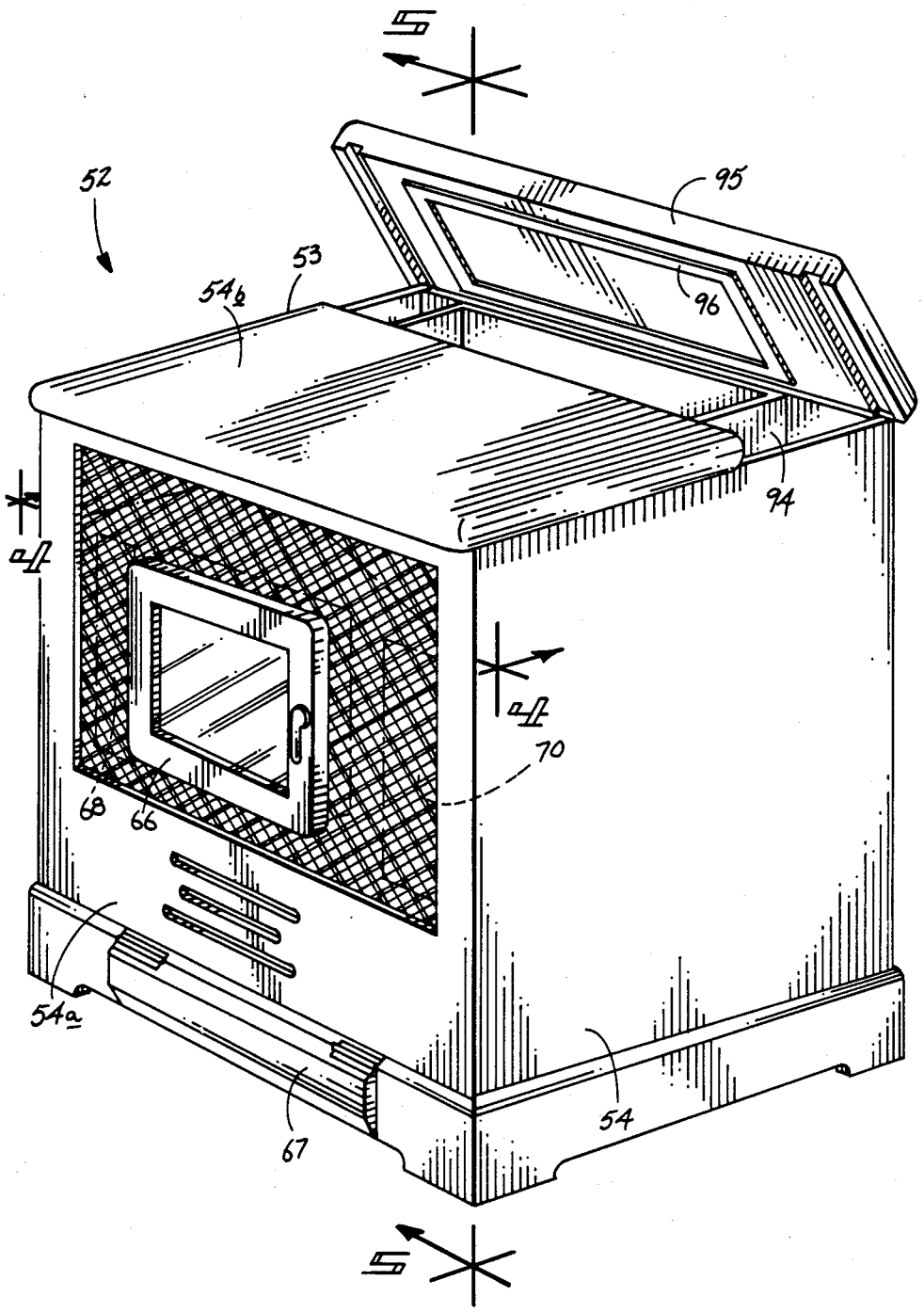
FIG. 3 is a perspective view of a complete pellet burner in accordance with the invention; a fuel supply access door is shown in an open position.

Referring to FIGS. 1 and 2, a burner for burning granular, pellet or similarly sized solid heating fuel 40 is indicated generally by reference numeral 10. Burner 10 includes a retort 12 for burning solid fuel, and feed means 14 for supplying solid fuel thereto.

Retort 12 includes a hollow tubular base piece 15 which has a horizontally extending lower portion 16 and an elbow portion 18 at one end which curves upwardly to form an upright central axis 20. The opposite end of horizontal portion 16 terminates in a retaining flange 22 for mounting the burner relative to a burning chamber in which the retort is adapted to be received, as is more fully described below. A vertically oriented hollow cylindrical sleeve 36 is received internally atop elbow portion 18 and extends upwardly about central axis 20.

A fuel supply tube 24 extends through flange 22 and into the hollowed central portion of horizontal portion 16 of retort base 15. The outer end portion of tube 24 includes a vertical, upwardly extending passageway or throat 26 which terminates in a mounting flange 28. Flange 28 mounts a hopper 94 (See FIG. 5) for retaining solid fuel to be fed through throat 26 and into retort horizontal portion 16. A screw feeder 30 extends along tube 24 from throat portion 26 and terminates adjacent upright central axis 20 within horizontal portion 16 of retort base 15. A motor 32 rotationally drives screw feeder 30 for feeding solid fuel to the retort for burning. Tube 24, throat 26, screw 30, and motor 32 comprise feed means 14. In the illustrated embodiments, the feed means supplies fuel upwardly through the bottom portion of retort 12 for combustion. Feeding of fuel through the top or side portion of a retort could alternately be employed, although bottom feeding is preferred.

Retort 12 has a predetermined elevation at which an upper surface 38 of the solid fuel is maintained in a burning condition during burner operation. Uppermost surface 38 within retort 12 is somewhat arcuate, having a marginally higher elevation at the periphery of the retort than at the center adjacent upright central axis 20.

An igniter means is mounted internally within retort 12 for initiating self-sustaining combustion of solid fuel 40 at its uppermost surface 38. The igniter means is illustrated as being in the form of an annular igniter 42 which extends about the internal periphery of retort 12. It comprises an electrical resistance element which is positioned adjacent the internal surfaces of the retort sidewalls just beneath uppermost surface 38 of solid fuel 40. Although an annular electrical resistance element is disclosed, alternately shaped, positioned, and powered igniters could be used without departing from the principles and scope of the invention. However, an annular, peripheral igniter provides the distinct advantage of not interfering with rising solid fuel being fed to uppermost surface 38 by means of rotating screw feeder 30.

Combustion air supply means is provided to emit combustion air radially outward from upright central axis 20 within retort 12 at the fuel surface 38. This radially outward emission of combustion air assists in burning solid fuel evenly across uppermost surface 38. In the preferred embodiment, the combustion air supply means is in the form of a hollow tube 44 which extends into retort 12 from a top portion thereof and downwardly along upright central axis 20. The lowermost portion of tube 44 extends into retained solid fuel 40 a small extent and includes a pointed end 46. In this manner, the combustion air supply means is coaxially spaced radially inward relative to annular peripheral igniter 42. The end of tube 44 is pointed to assist in passage of rising solid fuel to uppermost surface 38 around the exterior of tube 44.

Tube 44 includes a plurality of apertures 48 positioned to emit combustion air within retort 12 above igniter 42. Apertures 42 extend circumferentially around as well as axially along tube 44. This provides combustion air which is emitted radially outward within the retort at a plurality of axially spaced locations along the upright central axis above fuel uppermost surface 38. Supplying combustion air in this manner elevationally above fuel surface 38 assists in combustion of gases rising upwardly from surface 38.

A flame deflector 50 is positioned axially above the top of retort 12. It comprises a flat circular plate which extends radially outward the same peripheral distance as retort 12. Flame deflector 50 functions to concentrate heat and promote more complete burning of fuel within retort 12. Combustion air supply tube 44 extends downwardly through flame deflector 50 and into retort 12 along upright central axis 20. A flange 51 extends outwardly from tube 44 and elevationally retains flame deflector 50 relative to retort 12.

Combustion air is preferably supplied to retort 12 entirely through tube 44. This enables radially outward flowing combustion air to more completely and evenly burn fuel across a given elevational cross section of the retort. As such, the vertical sidewalls of the retort are preferably constructed to be impervious to inward passage of combustion air. Were the walls constructed to be somewhat porous, it would be preferable to supply a flow rate of combustion air through tube 44 that was sufficiently great to prevent inward passage of air through any retort pores. Conventional pellet stoves typically provide combustion to the retort means by inward passage through apertures or pores in the sidewalls of a retort. This tends to produce a very intense burn at the center of the retort but not at locations within the retort which are radially displaced from the center. The present apparatus achieves a more efficient burn by radially emitting all or at least a portion of the combustion air outwardly from the center portion of the retort to achieve complete and more even burning of the solid fuel across its uppermost surface.

Reference is made to FIG. 2 for an explanation of a typical burning profile of the upper portion of solid fuel 40 produced by the described apparatus. For purposes of illustration, retort 12 can be considered as divided into three elevational ranges 1, 2, and 3, shown diagrammatically at the left in FIG. 2. Elevation range 3 comprises that area within retort 12 which is elevationally above uppermost surface 38 of retained solid fuel 40. Elevation range 2 is immediately below range 3 and extends downwardly to some predetermined point where solid fuel is beginning to heat to the point of combustion. Elevation range 1 is immediately below range 2, and comprises that level at which fuel is being horizontally fed to the vertical burn portion of retort 12.

After fuel within the burner has been ignited and steady state burning conditions have been reached, typical temperatures will be as follows. Within elevation 1, the average fuel temperature will fall somewhere between 150° and 200° F. This is below the combustion temperature of the pellets. Combustion occurs within elevation 2. The average temperature within elevation 2 will vary from 300° F. up to 1100° F. Again for ease of illustration, elevation range 2 is divided into three sections comprised of lower section 2A, mid section 2B, and upper section 2C. Within section 2A, the temperature of the pellets is rapidly increasing elevationally as the fuel reaches section 2B. The average temperature within section 2A is approximately 500° F. Within section 2B, the fuel will begin to char and form a blackened charcoal-like substance. The average temperature within section 2B will be approximately 700° F. As fuel continues to flow upwardly to uppermost surface 38 within section 2C, the fuel is exposed to combustion air being emitted from supply tube 44, which produces a visible flame. The average temperature within section 2C is approximately 1100° F. Further combustion of rising gases occurs within elevation range 3 above uppermost surface 38. Temperatures within this region of retort 12 can reach from 2200° to 2500° F. as substantially complete combustion of the rising gases occurs.

As illustrated, the elevational position of electrical igniter 42 is at the uppermost portion of section 2B. The first row of combustion apertures 48 is positioned in section 2C, immediately above igniter 42. In this manner, the igniter is completely immersed in solid fuel and is below the hottest combustion area of the solid fuel. This preferred positioning increases the life of the igniter as it is not directly exposed to the higher combustion temperatures. This preferred positioning also enables the igniter upon activation, to more quickly start fuel burning within section 2C than would occur were the igniter to be placed above upper surface 38, or within section 2C. However, alternate elevational positioning of an igniter could of course be employed without departing from the invention.

FIGS. 3–6 illustrate a complete pellet burning apparatus 52. Burner 52 comprises a cabinet 53 which includes aesthetically pleasing front, side, rear, top and bottom cabinet walls 54. Cabinet walls 54 define a hollow internal cavity 56 which receives the retort, feed means, igniter means, combustion air supply means and other various operational components as is more fully described below.

A burn chamber 58 is received within walls 54 and fills the major portion of the front half of cavity 56. Burn chamber 58 includes an upper portion 60 and a lower portion 62. Chamber 58 is hollow throughout defining a burn cavity 59. Upper portion 60 is larger than lower portion 62 and connects at its lower end therewith. Upper portion 60 is six-sided, having the general appearance of a widened honeycomb cell. Lower portion 62 is substantially rectangular in cross section. The front wall of upper portion 60 includes an outwardly projecting hollow, rectangular extension 64 which terminates in a glass viewing and access door 66. Door 66 projects outwardly just past the front cabinet wall **54*a* of burner 52. The upper portion of front cabinet wall 54*a* is grated to enable outward passage of heated convection air. The lower portion of front cabinet wall 54*a* also includes slots 63 to enable outward passage of heated convection air from the lower portion of cabinet 53. Extension 64 extends through the grated portion of front cabinet wall 54*a*. A pair of vertically elongated convection air passageways 68, 70 (FIG. 4) extends through burn chamber 58 on opposite sides of extension 64 and door 66 in upper portion 60. Convection air for heating is forced through these passageways by fans 112 (FIG. 5) and emitted into the room of the building being heated through the grated portion of front cabinet wall 54*a***.

A hinged access door 65 extends across the bottom portion of the front wall of lower portion 62 of burn chamber 58. Door 65 functions to permit removal of ashes which are emitted outwardly from the retort during combustion and collect in lower portion 62 of burn chamber 58. A hinged door 67, corresponding in position to hinged door 65, is also included in front cabinet wall 54*a* to enable easy access to door 65.

Figure 4:
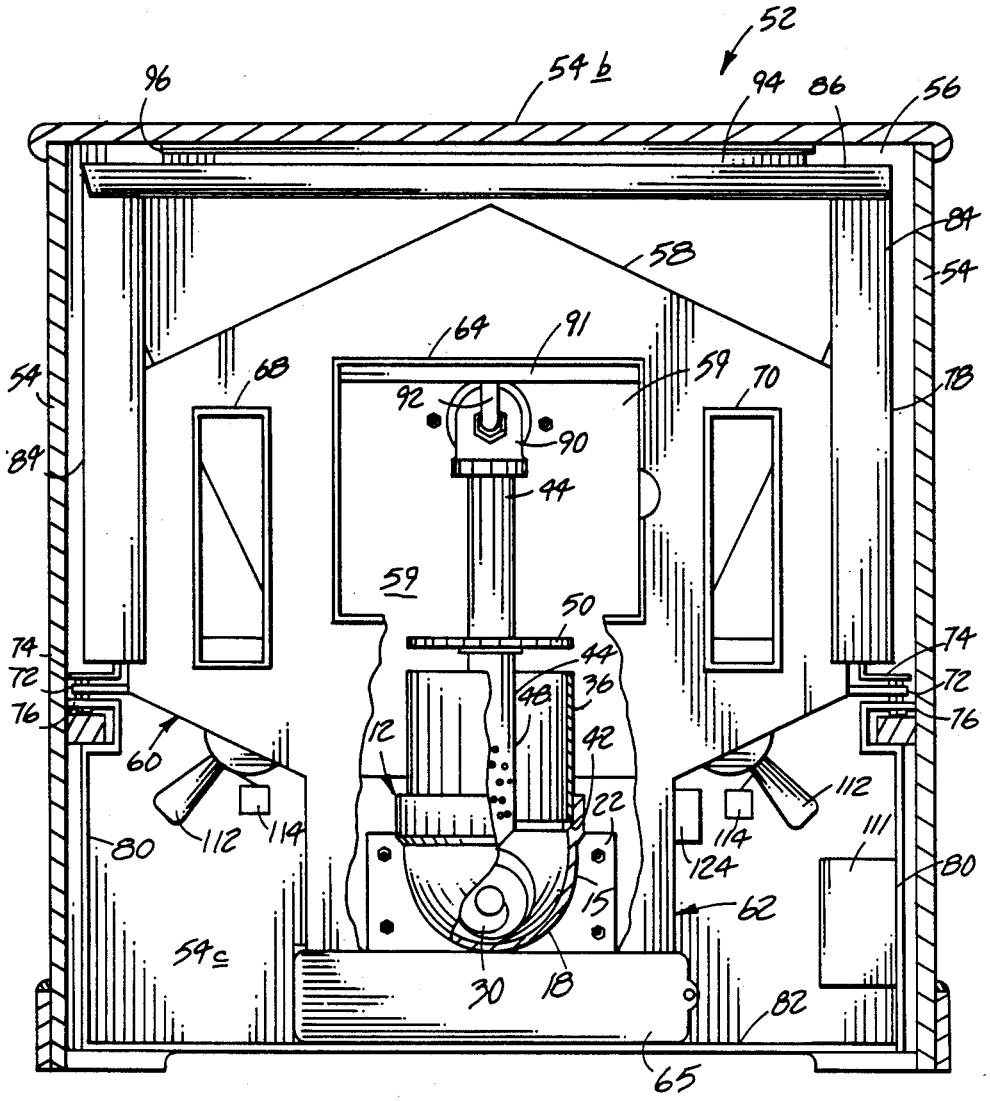
FIG. 4 is a fragmentary cross-sectional view taken along line 4—4 in FIG. 3; the fuel supply access door is shown in the closed position.

Opposed flanges 72 extend outwardly from the walls of upper portion 60 of burn chamber 58 for mounting of the burn chamber within cabinet cavity 56. Flanges 58 are sandwiched between flanges 74 and flanges 76 of an upper shroud 78 and a lower shroud 80, respectively (FIG. 4). Lower shroud 80 is trough-like, being open at its front and rear ends. Lower portion 62 of burn chamber 58 rests on a floor surface 82 of lower shroud 80. Accordingly, shroud 80 functions as a positioning device for securing burn chamber 58 within cabinet chamber 56.

Upper shroud 78 includes side, top and rear walls 84, 86, and 88 respectively. The forward portion of side walls 84 are beveled inwardly, and the forward portion of top wall 86 beveled downwardly, to assist in directing convection air outwardly through the grate portion of front cabinet wall 54*a*. The lower outer portions of rear wall 88 taper inwardly and rearwardly to provide sufficient space for convection air to flow through passageway 68, 70, as will be more fully described below Retort 12 is centrally positioned within the lower portion of burn chamber 58. Horizontal portion 16 of retort 12 extends through a hole formed in a rear wall of lower portion 62 of burn chamber 58. Mounting flange 22 of horizontal portion 16 abuts against the interior portion of the rear wall of burn chamber 58 and bolts thereto. Vertical sleeve portion 36 of retort 12 extends upwardly into upper portion 60 of burn chamber 58 to an elevation just below horizontal door extension 64.

Combustion air supply tube 44 extends inwardly from the rear wall of upper portion 60 of burn chamber 58 and angles at ninety degrees to extend into retort 12. Combustion air supply tube 44 includes an elbow connecter 90 at the ninety degree bend. An air conduit 92 connects to elbow 90 and extends in angled upward fashion to a horizontally positioned air supply bar 91 positioned to emit air downwardly adjacent glass door 66. This downwardly emitted air assists in keeping glass door 66 clean and clear, and also provides additional combustion air which is emitted from outside of retort 12 to within cavity 59 to assist in further combustion of gases being emitted from retort 12.

A metal fuel hopper 94 is provided rearwardly adjacent burn chamber 58 and upper shroud 78 within rearward portion of cabinet cavity 56. Hopper 94 includes a flange 97 which bolts to mounting flange 28 of the vertical portion of feed means 14, which defines fuel feed passageway 26. Screw feeder motor 32 is mounted rearwardly adjacent the lower end of throat or passageway 26 for driving screw feeder 30. This configuration supplies fuel from hopper 94 to the burn area within retort 12 in a regulated manner as is more fully described below.

Figure 5:
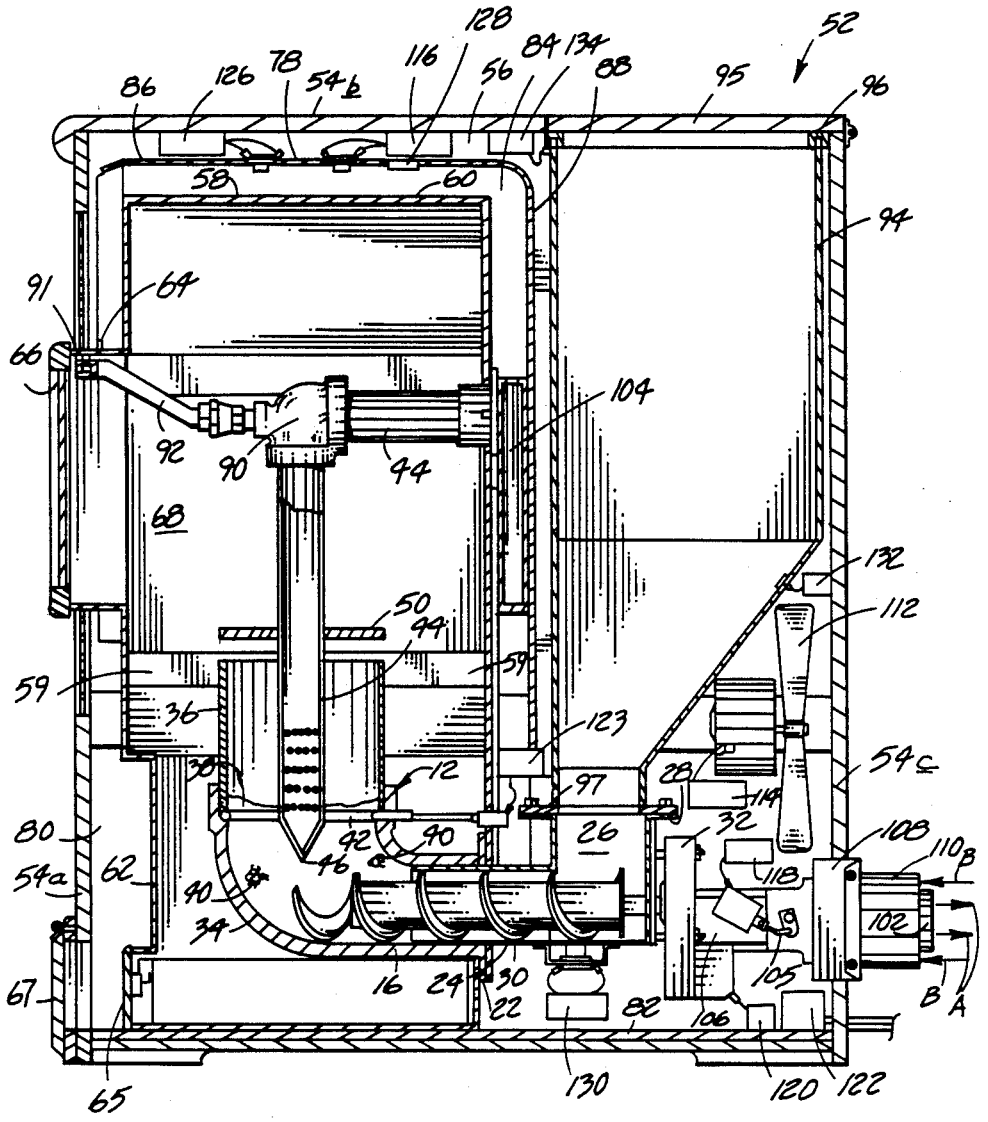
FIG. 5 is a cross-sectional view taken along line 5—5 in FIG. 3; the fuel supply access door is shown in the closed position.
Figure 5:
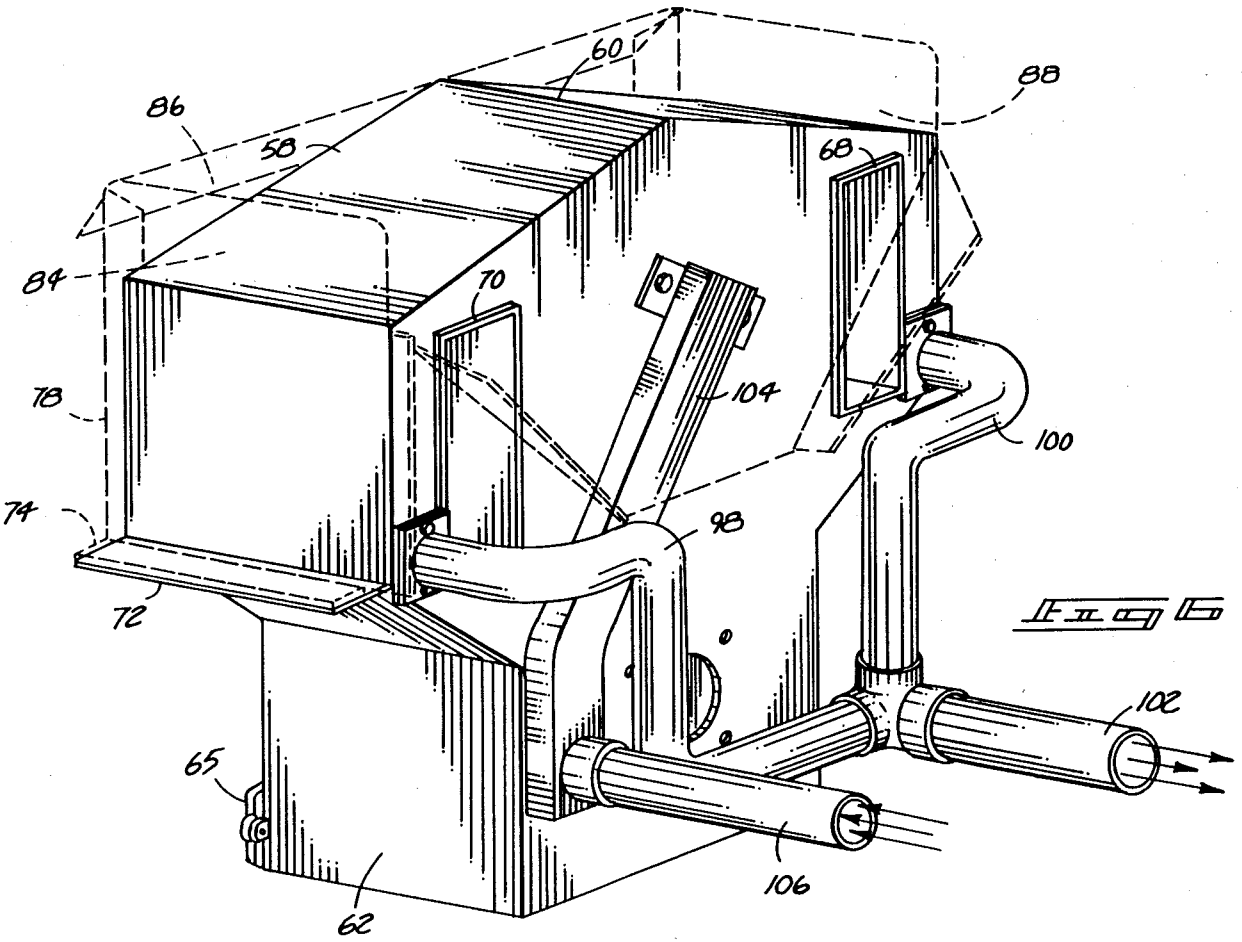

The rear portion of top cabinet wall 54*b* includes a pivoting door which is positioned atop hopper 94. A plastic coated magnetic seal 96, similar to that employed with refrigerator doors, is secured to door 95 and is positioned to coincide with the top periphery of hopper 94. Magnetic seal 96 provides an airtight seal relative to hopper 94 when door 95 is closed, as shown in FIGS. 4 and 5.

An exhaust system communicates with cavity 59 for exhausting combustion gases emitted from retort 12 to within cavity 59. The exhaust system comprises a pair of exhaust conduits 98, 100 which extend through the rear portion of burn chamber 58 into chamber cavity 56 outwardly adjacent the lowermost portion of convection passageways 68, 70 (see FIG. 6). Exhaust conduits 98, 100 connect to form a single exhaust conduit 102 which extends outwardly through the left rear side of the lowermost portion of exterior cabinet walls 54. Exhaust conduit 102 is connected to an exhaust fan (not shown) typically placed at the exterior of the building being heated by burner 52.

Combustion air supply tube assembly 44 connects with a rectangular air supply conduit 104 which angles downwardly along the right rear portion on the exterior of burn chamber 58. A circular conduit 106 communicates with conduit 104 and extends to connect at the left rear lower portion of cabinet cavity 56 with an air supply box 108. Exhaust conduit 102 sealingly extends through the central portion of box 108 (FIG. 5). A combustion air supply valve assembly 105 is included where conduit 106 meets supply box 108. An enlarged circular conduit 110 extends rearwardly from box 108 out from the rear cabinet wall 54*c*. Exhaust conduit 102 is coaxially inwardly spaced to extend through larger conduit 110 defining an annular space through which combustion air flows to box 108. Accordingly, exhaust is drawn from cabinet 52 through circular conduit 102 along arrows A, while combustion air is supplied through burner 52 to burn chamber 58 around conduit 102 and through conduit 110 along arrows B.

Such an exhaust/combustion air supply system is typically referred to as a negative draft system, as the exhaust fan connected to conduit 102 creates a pressure which is less than atmospheric within burn chamber 58. With such systems, combustion air is supplied to burn chamber at substantially ambient atmospheric pressure. Alternate exhaust/combustion air supply systems could, of course, be employed without departing from the principles and scope of the invention.

A pair of convection fans 112 is mounted internally within cabinet cavity 56 on opposite sides of and rearwardly adjacent the lower portion of hopper 94. Fans 112 functin to provide a rather large volume of convection air for passage through passageways 68, 70 for heating and emission through the grate portion of front cabinet wall 54*a*.

Various operational and safety electronic circuits are retained within cabinet cavity 56 for providing safe and efficient, thermostatically controlled operation of burner 52. Such systems are preferably configured to enable burner 52 to be thermostatically controlled from a conventional wall thermostat. A master control circuit 111 is employed for controlling the various circuits housed within cabinet 53. Sub-circuits include convection fan controller 114, convection air temperature sensor circuit 116, combustion air controller 118, screw feeder motor controller 120, exhaust fan controller 122, igniter controller 123 and burn chamber temperature sensor circuit 124. Such sub-circuits are operably connected with the master control circuit 111 which coordinates overall operation of burner 52. A thermostat (not shown) also preferably connects to controller 111 and mounts to a wall within the building in which burner 52 is operated.

A starting sequence for igniting burner 52 is described as follows. With power being supplied to master control circuit 111, the wall thermostat senses a low temperature condition within the building or room being heated. Controller 111 thereafter activates igniter controller 123, which supplies electricity to electrical resistant igniter element 42 to initiate self-sustaining combustion of solid fuel within the retort. In the embodiment shown, the igniter is operated for slightly more than three minutes which heats the upper portion of the retained solid fuel sufficiently to initiate self-sustaining combustion. Thereafter, the controller deactivates the igniter. Although a timed sequence is described for operation of the igniter, the igniter controller could also include a temperature sensor control which deactivates the igniter upon reaching a predetermined temperature evidencing self-sustaining combustion.

At some point during ignition or shortly thereafter, controller 111 activates exhaust fan controller 122 and combustion air valve controller 118 to begin supplying combustion air through supply tube assembly 44 to solid fuel upper surface 38. Screw motor controller 120 is also activated to begin supplying a slow but steady flow of fuel to upper surface 38 within retort 12 for burning. Convection temperature sensor control circuit 116 senses temperature immediately adjacent the upper exterior of burn chamber 58. When such temperature reaches approximately 120 degrees F., the controller 111 activates convection fan controller 114 to operate fans 112. This blows convection air for heating through passageways 68, 70, and out the front end of the stove.

When the temperature in the room has reached the thermostat setting, controller 111 shuts down the auger motor, exhaust fan, and combustion air supply valve to stop the burn within retort 12. Shortly thereafter, the temperature adjacent burn chamber 58 falls below 120 degrees F., causing the convection air controller circuit to turn convection fans 112 off.

When temperature in the room or building again falls below the predetermined thermostat setting, master controller 111 first accesses burn chamber sensor 124 to determine if there is sufficient heat within retort 12 to begin self-sustaining combustion. If the temperature is sufficient, the exhaust fan, auger motor and combustion air valve are caused to be activated, which begins combustion. If the temperature is not sufficiently high to initiate self-sustaining combustion, master controller 111 activates the igniter circuit and begins the ignition sequence described above.

Burner 52 also has a number of safety features for shutting down the burner in the event excessive temperatures are reached to prevent a fire. Each of the safety circuits employs a sensor which, upon reaching a predetermined condition, signals controller 111 to turn off the combustion air supply valve, auger motor, and exhaust fan. One such sensor is a high temperature sensor 126 positioned within the upper portion of cabinet cavity 56 adjacent convection fan temperature sensor circuit 116. Sensor 126 is preferably configured to signal controller 111 when a temperature of 185 degrees F. is reached within chamber 56.

A second backup high temperature sensor 128 is also positioned adjacent convection air temperature circuit 116. It preferably signals master controller 111 to shut the system down if a temperature of 200 degrees F. is reached. High temperature sensor 128 also preferably employs a fuse or circuit breaker mechanism which must be replaced or reset upon activation to alert the operator to a potential problem.

Yet another safety feature is burn-back safety temperature sensor 130. This sensor constantly monitors temperature within the horizontal portion of the retort and feed means to insure that fuel at this location is not heated to the point of ignition. If it were, master controller 111 would be signaled to turn off the combustion air supply valve, auger motor, and exhaust fan.

Another safety sensor is low fuel sensor 132. This sensor signals master controller 111 when the fuel level within hopper 94 falls below a predetermined elevation. The volume of fuel within hopper 94 creates an air barrier which prevents air from flowing into feed supply tube 24 and subsequently to the retort. The low fuel sensor senses a low fuel condition to prevent any air present within cavity 56 from flowing through the lower mass of fuel and into the retort.

Another safety feature is hopper lid switch 134. This switch, upon opening of cabinet door 95, signals master controller 111 to shut the system off to prevent any air from flowing into the hopper and into the retort to prevent a burn-back condition from developing. Upon closing the door, the motor, exhaust fan and combustion air valve function in their previous operational mode.

The various components of burner 52 are constructed of conventional materials. For example, retort 12 is constructed of cast iron. Deflector shields 50, 63 are constructed of stainless steel. Burn chamber 58 is constructed of $\frac{1}{8}$" plate steel. Heat is removed at such a rate from cabinet cavity 56 that cabinet walls 54 can be constructed of wood.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A burner for burning granular, pellet or similarly sized solid heating fuel, comprising:

retort means for burning solid fuel, the retort means having an upright central axis and a predetermined elevation at which an uppermost surface of solid fuel is adapted to reach and be maintained at for burning within the retort means;

feed means for supplying solid fuel to the retort means;

igniter means mounted internally within the retort means for initiating self-sustaining combustion of solid fuel at its uppermost surface, the igniter comprising an electrical resistance element that annularly extends about the internal periphery of the retort means at the predetermined elevation and which in operation contacts the solid fuel; and combustion air supply means centered along the upright central axis at the predetermined elevation for emitting combustion air radially outward from the center portion of the retort means at the predetermined elevation to burn solid fuel evenly across its uppermost surface.

2. The burner of claim 1 wherein the combustion air supply means is positioned within the retort means to emit combustion air above the igniter means.

3. The burner of claim 1 wherein the combustion air supply means includes a plurality of apertures positioned along the upright central axis to emit combustion air radially outward within the retort means at a plurality of axially spaced locations above the predetermined elevation to assist in the combustion of rising gases produced by burning of solid fuel.

4. The burner of claim 1 wherein the combustion air supply means is positioned within the retort means to emit combustion air above the igniter means and includes a plurality of apertures positioned along the upright central axis to emit combustion air radially outward within the retort means at a plurality of axially spaced locations above the predetermined elevation to assist in the combustion of rising gases produced by burning of solid fuel.

5. The burner of claim 1 wherein the feed means supplies fuel upwardly through a bottom portion of the retort means, the combustion air supply means comprising a tube extending downwardly along the upright central axis and being coaxially spaced radially inward of the annularly extending electrical resistance element.

6. The burner of claim 1 further comprising:

a flame deflector positioned atop the retort means to concentrate heat and promote more complete burning of fuel within the retort means.

7. The burner of claim 6 wherein the combustion air supply means extends downwardly through the flame deflector and into the retort means.

8. The burner of claim 1 wherein the combustion air supply means comprises a tube which extends into the retort means from a top portion of the retort means, the tube in operation extending into the solid fuel and being positioned to emit combustion air immediately above the igniter means;

the retort means including sidewalls which are substantially impervious to inward passage of combustion air, combustion air being supplied substantially entirely to the retort means through the tube.

9. The burner of claim 1 further comprising:

exterior walls which define a cavity in which the retort means is received.

10. The burner of claim 9 further comprising:

exhaust means in communication with the cavity for exhausting combustion gases emitted from the retort means into the cavity, the exhaust means creating a pressure within the cavity which is below ambient atmospheric pressure, the combustion air supply means providing combustion air at ambient atmospheric pressure to the retort means.

11. The burner of claim 9 further comprising:

a flame deflector positioned atop the retort means to concentrate heat and promote more complete combustion of fuel within the retort means; and the combustion air supply means emitting combustion air from outside of the retort means to within the cavity to assist in further combustion of gases being emitted from the retort means.

12. The burner of claim 1 further comprising:

temperature activated thermostatic control means for (a) regulating a feed rate of solid fuel to the retort means as supplied by the feed means, and (b) regulating supply of combustion air to the retort means.

13. The burner of claim 1 further comprising:

igniter control means for (a) activating the igniter means to initiate self-sustaining combustion of solid fuel within the retort means, and (b) deactivating the igniter means after self-sustaining combustion of solid fuel has been initiated.

14. The burner of claim 13 further comprising:

temperature activated thermostatic control means for (a) regulating a feed rate of solid fuel to the retort means as supplied by the feed means, and (b) regulating supply of combustion air to the retort means.

15. A burner for burning granular, pellet, or similarly sized solid heating fuel, comprising:

exterior walls which define a cavity;

retort means for burning solid fuel, the retort means having an upright central axis and a predetermined elevation at which an uppermost surface of solid fuel is adapted to reach and be maintained at for burning within the retort means; the retort means further including a flame deflector positioned adjacent a top portion of the retort means to concentrate heat and promote more complete combustion of fuel within the retort means; the retort means additionally including sidewalls which are substantially impervious to inward passage of combustion air;

feed means for supplying solid fuel to the retort means;

igniter means mounted internally within the retort means and extending about the internal periphery of the retort means for initiating self-sustaining combustion of solid fuel at its uppermost surface;

combustion air supply means extending downwardly through the flame deflector and into the retort means along the upright central axis, and being positioned at the predetermined elevation and above the igniter means for emitting combustion air radially outward from the upright central axis within the retort means to burn solid fuel evenly across its uppermost surface, the combustion air supply means also emitting combustion air from outside of the retort means to within the cavity to assist in further combustion of gases being emitted from the retort means and around the flame deflector; and the combustion air supply means including a plurality of apertures positioned along the upright central axis to emit combustion air radially outward within the retort means at a plurality of axially spaced locations above the predetermined elevation to assist in the combustion of rising gases produced by burning of solid fuel.

16. The burner of claim 15 further comprising:

temperature activated thermostatic control means for (a) regulating a feed rate of solid fuel to the retort means as supplied by the feed means, and (b) regulating supply of combustion air to the retort means; and igniter control means for a) activating the igniter means to initiate self sustaining combustion of solid fuel within the retort means, and b) deactivating the igniter means after self-sustaining combustion of solid fuel has been initiated.

17. A burner for burning granular, pellet, or similarly sized solid heating fuel, comprising:

exterior walls which define a cavity;

retort means for burning solid fuel, the retort means having an upright central axis and a predetermined elevation at which an uppermost surface of solid fuel is adapted to reach for burning within the retort means;

feed means for supplying solid fuel to the retort means, the feed means supplying fuel to the retort means upwardly through a bottom portion of the retort means; and combustion air supply means positioned along the upright central axis at the predetermined elevation for emitting combustion air radially outward from the upright central axis within the retort means to burn solid fuel evenly across its uppermost surface, the combustion air supply means comprising a tube which extends downwardly into the retort means from a topmost portion of the retort means to enable upwardly moving solid fuel supplied by the feed means to easily pass to the predetermined elevation for burning, the tube in operation contacting solid fuel within the retort means, the tube supplying substantially the entirety of the combustion air to within the retort means.

18. The burner of claim 17 further comprising:

annular igniter means extending about the internal periphery of the retort means at the predetermined elevation for initiating self-sustaining combustion of solid fuel at its uppermost surface, the annular igniter means comprising an electrical resistance element which in operation contacts the solid fuel.

19. The burner of claim 17 wherein the tube includes a plurality of apertures positioned along the upright central axis to emit combustion air radially outward within the retort means at a plurality of axially spaced locations above the predetermined elevation to assist in the combustion of rising gases produced by burning of solid fuel.

20. A burner for burning granular, pellet, or similarly sized solid heating fuel, comprising:

exterior walls which define a cavity;

retort means for burning solid fuel, the retort means having an upright central axis and a predetermined elevation at which an uppermost surface of solid fuel is adapted to reach for burning within the retort means;

feed means for supplying solid fuel to the retort means, the feed means supplying fuel to the retort means upwardly through a bottom portion of the retort means;

combustion air supply means positioned along the upright central axis at the predetermined elevation for emitting combustion air radially outward from the upright central axis within the retort means to burn solid fuel evenly across its uppermost surface, the combustion air supply means extending downwardly into the retort means from a topmost portion of the retort means to enable upwardly moving solid fuel supplied by the feed means to easily pass to the predetermined elevation for burning;

a flame deflector positioned atop the retort means to concentrate heat and promote more complete burning of fuel within the retort means;

the combustion air supply means extending into the retort means through a central portion of the flame deflector along the upright axis; and wherein the combustion air supply means branches before entering into the retort means to also emit combustion air from outside of the retort means to within the cavity to assist in further combustion of gases being emitted from the retort means and around the flame deflector.

21. The burner of claim 17 further comprising:

temperature activated thermostatic control means for (a) regulating a feed rate of solid fuel to the retort means as supplied by the feed means, and (b) regulating supply of combustion air to the retort means.

22. The burner of claim 17 further comprising:

exhaust means in communication with the cavity for exhausting combustion gases emitted from the retort means into the cavity, the exhaust means creating a pressure within the cavity which is below ambient atmospheric pressure, the combustion air supply means providing combustion air at ambient atmospheric pressure to the retort means.

23. A burner for burning granular, pellet or similarly sized solid heating fuel, comprising:

exterior walls which define a cavity;

retort means for burning solid fuel, the retort means having an upright central axis and a predetermined elevation at which an uppermost surface of solid fuel is adapted to reach for burning within the retort means;

feed means for supplying solid fuel to the retort means; and annular igniter means mounted internally within the retort means and extending about the internal periphery of the retort means for initiating self-sustaining combustion of solid fuel at its uppermost surface, the annular igniter means comprising an electrical resistance element which in operation contacts the solid fuel.

24. The burner of claim 23 further comprising:

igniter control means for (a) activating the igniter means to initiate self sustaining combustion of solid fuel within the retort means, and (b) deactivating the igniter means after self-sustaining combustion of the retained solid fuel has been initiated.

25. The burner of claim 23 further comprising:

igniter control means for (a) activating the electrical resistance element to initiate self sustaining combustion of solid fuel, and (b) deactivating the electrical resistance element after self-sustaining combustion of solid fuel has been initiated.

26. The burner of claim 17 wherein the tube includes a lowermost end, the lowermost end being pointed and in operation contacting solid fuel within the retort means.

27. The burner of claim 8 wherein the tube includes a lowermost end, the lowermost end being pointed and in operation contacting solid fuel within the retort means.

* * * * *